US012454744B2

(12) United States Patent
Resiak

(10) Patent No.: US 12,454,744 B2
(45) Date of Patent: Oct. 28, 2025

(54) METHOD FOR PRODUCING A STEEL PART AND CORRESPONDING STEEL PART

(71) Applicant: ArcelorMittal, Luxembourg (LU)

(72) Inventor: Bernard Resiak, Saulny (FR)

(73) Assignee: ArcelorMittal, Luxembourg (LU)

( * ) Notice: Subject to any disclaimer, the term of this patent is extended or adjusted under 35 U.S.C. 154(b) by 397 days.

(21) Appl. No.: 16/613,712

(22) PCT Filed: May 22, 2018

(86) PCT No.: PCT/IB2018/053598
§ 371 (c)(1),
(2) Date: Nov. 14, 2019

(87) PCT Pub. No.: WO2018/215923
PCT Pub. Date: Nov. 29, 2018

(65) Prior Publication Data

US 2020/0385847 A1 Dec. 10, 2020

(30) Foreign Application Priority Data

May 22, 2017 (WO) ..... PCT/IB2017/053004

(51) Int. Cl.

| | |
|---|---|
| ***C22C 38/00*** | (2006.01) |
| ***C21D 8/02*** | (2006.01) |
| ***C21D 8/06*** | (2006.01) |
| ***C22C 38/02*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| *C22C 38/58* | (2006.01) |

(52) U.S. Cl.
CPC ..... *C22C 38/54* (2013.01); *C21D 8/0263* (2013.01); *C21D 8/065* (2013.01); *C22C 38/001* (2013.01); *C22C 38/002* (2013.01); *C22C 38/02* (2013.01); *C22C 38/06* (2013.01); *C22C 38/44* (2013.01); *C22C 38/48* (2013.01); *C22C 38/50* (2013.01); *C21D 2211/001* (2013.01); *C21D 2211/002* (2013.01); *C21D 2211/008* (2013.01); *C22C 38/58* (2013.01)

(58) Field of Classification Search
None
See application file for complete search history.

(56) References Cited

U.S. PATENT DOCUMENTS

| | | | |
|---|---|---|---|
| 5,213,637 | A | 5/1993 | Herro et al. |
| 2004/0226635 | A1 | 11/2004 | Ikeda et al. |
| 2010/0307644 | A1 | 12/2010 | Gil Otin et al. |
| 2012/0132327 | A1 | 5/2012 | Mukai et al. |
| 2014/0242416 | A1* | 8/2014 | Matsuda ..... C22C 38/08 428/659 |
| 2014/0283960 | A1 | 9/2014 | Liu et al. |
| 2015/0267282 | A1 | 9/2015 | Schaffnit et al. |
| 2017/0009316 | A1 | 1/2017 | Yamazake et al. |
| 2017/0197235 | A1 | 7/2017 | Shuto et al. |
| 2018/0044754 | A1 | 2/2018 | Azuma et al. |
| 2018/0057909 | A1 | 3/2018 | Perrot-Simonetta et al. |

FOREIGN PATENT DOCUMENTS

| | | | |
|---|---|---|---|
| CN | 101765668 | A | 6/2010 |
| CN | 104513930 | A | 4/2015 |
| CN | 105143474 | A | 12/2015 |
| CN | 105256240 | A | 1/2016 |
| CN | 106103770 | A | 11/2016 |
| CN | 106661689 | A | 5/2017 |
| EP | 2365103 | A1 | 9/2011 |
| EP | 2895635 | A1 | 7/2015 |
| JP | H07278730 | A | 10/1995 |
| JP | 2002097547 | A | 4/2002 |
| JP | 2010275608 | A | 12/2010 |
| JP | 2012126974 | A | 7/2012 |
| JP | 2016079477 | A | 5/2016 |

(Continued)

OTHER PUBLICATIONS

The International Search Report issued in connection with International application No. PCT/IB2018/053598.
The International Search Report issued in connection with International application No. PCT/IB2017/053004.

*Primary Examiner* — Kim S. Horger
(74) *Attorney, Agent, or Firm* — Davidson Kappel LLC

(57) ABSTRACT

A method for producing a steel part and corresponding steel part includes casting a steel having a composition comprising: 0.10%≤C≤0.35%, 0.8%≤Si≤2.0%, 1.8%≤Mn≤2.5%, P≤0.1%, 0%≤S≤0.4%, 0%≤Al≤1.0%, N≤0.015%, 0%≤Mo≤0.4%, 0.02%≤Nb≤0.08%, 0.02%≤Ti≤0.05%, 0.001%≤B≤0.005%, 0.5%≤Cr≤1.8%, 0%≤V≤0.5%, 0%≤Ni≤0.5%, to obtain a semi-product, hot rolling the semi-product at a hot rolling starting temperature higher than 1000° C. and cooling the product through air to room temperature to obtain a hot rolled steel part having a microstructure consisting of 70% to 90% of bainite, 5% to 25% of M/A compounds and at most 25% of martensite. The bainite and the M/A compounds contain retained austenite such that the total content of retained austenite in the steel is comprised between 5% and 25%, the carbon content of the retained austenite being comprised between 0.8% and 1.5%.

31 Claims, No Drawings

(56) References Cited

FOREIGN PATENT DOCUMENTS

| | | | |
|---|---|---|---|
| KR | 20030055516 | A | 7/2003 |
| KR | 100851176 | B1 | 8/2008 |
| RU | 2291205 | C1 | 1/2007 |
| RU | 2493267 | C1 | 9/2013 |
| RU | 2553321 | C1 | 6/2015 |
| WO | WO2009138586 | A2 | 11/2009 |
| WO | WO2009138586 | A3 | 1/2010 |
| WO | WO2016079675 | | 5/2016 |
| WO | WO2016151345 | A1 | 9/2016 |
| WO | WO2016158961 | A1 | 10/2016 |

* cited by examiner

METHOD FOR PRODUCING A STEEL PART AND CORRESPONDING STEEL PART

The present invention concerns a method for producing a steel part and a deformed steel part having excellent mechanical properties, as well as a corresponding steel part and deformed steel part.

BACKGROUND

In recent years, an increasing need has arisen, in numerous industrial areas, to provide parts made of steel which offer a good compromise between their mechanical strength and their weight.

Applications for such parts are, in particular, to be found in the motor vehicle industry, for example for common rails of fuel injection systems of diesel engines or for other high strength high diameter automotive parts with an improved fatigue resistance.

For this purpose, steels have been developed which undergo a so-called TRIP (TRansformation Induced Plasticity) effect when they are subjected to deformation. More particularly, during deformation, the retained austenite contained in these steels is transformed into martensite, making it possible to achieve greater elongations and lending these steels their excellent combination of strength and ductility.

For example, EP 2 365 103 discloses a steel which is able to undergo such a TRIP effect. However, the steel disclosed in EP 2 365 103 is not entirely satisfactory.

Indeed, in order to obtain the required mechanical properties, it is necessary to subject the part obtained through hot rolling to a particular heat treatment called austempering, which requires that the steel part be held at a predetermined holding temperature comprised in a temperature range of between 300° C. and 450° C. for a time comprised between 100 and 2000s, but preferably equal to 1000s. The need to perform an austempering treatment increases the cost and effort for manufacturing the parts. In particular, the austempering treatment is generally performed by using salt baths, which appear to present safety and environmental problems.

SUMMARY

A high strength steel grade is provided which provides excellent mechanical properties for a reduced manufacturing cost and effort, and more particularly a steel grade having a yield strength greater than or equal to 750 MPa, a tensile strength greater than or equal to 1000 MPa and a uniform elongation greater than or equal to 10%, while getting an homogeneous microstructure without segregation and a good impact resistance.

A method for manufacturing a steel part is provided, comprising the following successive steps:

casting a steel so as to obtain a semi-product, said steel having a composition comprising, by weight:

$0.10\% \leq C \leq 0.35\%$
$0.8\% \leq Si \leq 2.0\%$
$1.8\% \leq Mn \leq 2.5\%$
$P \leq 0.1\%$
$0\% \leq S \leq 0.4\%$
$0\% \leq Al \leq 1.0\%$
$N \leq 0.015\%$
$0\% \leq Mo \leq 0.4\%$
$0.02\% \leq Nb \leq 0.08\%$
$0.02\% \leq Ti \leq 0.05\%$
$0.001\% \leq B \leq 0.005\%$
$0.5\% \leq Cr \leq 1.8\%$ $0\% \leq V \leq 0.5\%$
$0\% \leq Ni \leq 0.5\%$ the remainder being Fe and unavoidable impurities resulting from the smelting, hot rolling the semi-product at a hot rolling starting temperature higher than 1000° C. and cooling the thus obtained product through air cooling to room temperature so as to obtain a hot rolled steel part, said hot rolled steel part having, after air cooling to room temperature, a microstructure consisting, in surface fraction, of 70% to 90% of bainite, 5% to 25% of M/A compounds and at most 25% of martensite, the bainite and the M/A compounds containing retained austenite such that the total content of retained austenite in the steel is comprised between 5% and 25%, and the carbon content of the retained austenite being comprised between 0.8% and 1.5% by weight.

The method for manufacturing a steel part may further comprise one or more of the following features, taken along or according to any technically possible combination:

- the method further comprises a step of reheating the semi-product to a temperature comprised between 1000° C. and 1250° C. prior to hot rolling, the hot rolling being carried out on the reheated semi-product;
- the steel comprises between 0.9% and 2.0% by weight of silicon, more particularly between 1.0% and 2.0% by weight of silicon, even more particularly between 1.1% and 2.0% by weight of silicon, and even more particularly between 1.2% and 2.0% by weight of silicon;
- the steel comprises between 1.8% and 2.2% by weight of manganese;
- the steel comprises between 0% and 0.030% by weight of aluminum;
- the steel comprises between 0.05% and 0.2% by weight of molybdenum;
- the titanium and nitrogen contents are such that $Ti \geq 3.5 \times N$;
- the steel comprises between 0.5% and 1.5% by weight of chromium;
- after hot-rolling, the hot rolled steel part is cooled to room temperature, the cooling being preferably performed by air cooling, in particular natural air cooling or through controlled pulsed air cooling;
- after cooling to room temperature, the hot rolled steel part is cold formed, in particular cold press-formed, to obtain a hot rolled and deformed steel part;
- the method further comprises, after the hot rolling step, a step of heating said hot rolled steel part to a heat treatment temperature greater than or equal to the $Ac_3$ temperature of the steel for a time comprised between 10 minutes and 120 minutes, followed by cooling from said heat treatment temperature to room temperature so as to obtain a hot rolled and heat treated steel part;
- said cooling is an air cooling, in particular a natural air cooling or a controlled pulsed air cooling;
- between the step of heating the hot rolled steel part to the heat treatment temperature and the cooling to room temperature, the hot rolled steel part is hot formed, in particular hot press formed, the hot rolled and heat treated steel part being a hot-rolled, heat treated and deformed steel part;
- after the cooling from the heat treatment temperature to room temperature, the hot rolled and heat treated steel part is cold formed, in particular cold press formed, to obtain a hot-rolled, heat treated and deformed steel part.

A hot rolled steel part is also provided having a composition comprising, by weight:

0.10%≤C≤0.35%
0.8%≤Si≤2.0%
1.8%≤Mn≤2.5%
P≤0.1%
0%≤S≤0.4%
0%≤Al≤1.0%
N≤0.015%
0%≤Mo≤0.4%
0.02%≤Nb≤0.08%
0.02%≤Ti≤0.05%
0.001%≤B≤0.005%
0.5%≤Cr≤1.8%
0%≤V≤0.5%
0%≤Ni≤0.5% the remainder being Fe and unavoidable impurities resulting from the smelting, the hot rolled steel part having a microstructure consisting, in surface fraction, of 70% to 90% of bainite, 5% to 25% of M/A compounds and at most 25% of martensite, the bainite and the M/A compounds containing retained austenite such that the total content of retained austenite in the steel is comprised between 5% and 25 and the carbon content of the retained austenite being comprised between 0.8% and 1.5% by weight.

The hot rolled steel part may further comprise one or more of the following features, taken along or according to any technically possible combination:

- said hot rolled steel part has a yield strength (YS) greater than or equal to 750 MPa, a tensile strength (TS) greater than or equal to 1000 MPa and an elongation (El) greater than or equal to 10%;
- the hot rolled steel part is a solid bar having a diameter comprised between 25 and 100 mm;
- the hot rolled steel part is a wire having a diameter comprised between 5 and 35 mm.

DETAILED DESCRIPTION

The method for manufacturing a steel part according to the present disclosure comprises a step of casting a steel so as to obtain a semi-product, said steel having a composition comprising, by weight:

0.10%≤C≤0.35%, and more particularly 0.15%≤C≤0.30%,
0.8%≤Si≤2.0%, and preferably 1.2%≤Si≤1.5%
1.8%≤Mn≤2.5% and preferably 1.8%≤Mn≤2.2%
P≤0.1%
0%≤S≤0.4%, more particularly 0%≤S≤0.01%,
0%≤Al≤1%, and preferably 0%≤Al≤0.030%
N≤0.015%
0%≤Mo≤0.4%, and preferably 0.05%≤Mo≤0.2%
0.02%≤Nb≤0.08%, and preferably 0.04%≤Nb≤0.06%
0.02%≤Ti≤0.05%
0.001%≤B≤0.005%
0.5%≤Cr≤1.8%, more particularly 0.5%≤Cr≤1.5%, and preferably 0.65%≤Cr≤1.2%
0%≤V≤0.5%
0%≤Ni≤0.5% the remainder being Fe and unavoidable impurities resulting from the smelting.

In this alloy, carbon is the alloying element having the main effect to control and adjust the desired microstructure and properties of the steel. Carbon stabilizes the austenite and thus leads to its retention even at room temperature. Besides, carbon allows achieving a good mechanical resistance combined with a good ductility and impact resistance.

A carbon content below 0.10% by weight leads to the formation of a non-sufficiently stable retained austenite and also to the risk of pro-eutectoid ferrite appearance. This may result in insufficient mechanical properties. At carbon contents above 0.35%, the ductility and impact resistance of the steel are deteriorated by the appearance of center-segregation. Moreover a carbon content above 0.35% by weight decreases the weldability of the steel. Therefore, the carbon content is comprised between 0.10% and 0.35% by weight.

The carbon content is preferably comprised between 0.15% and 0.30% by weight.

The silicon content is comprised between 0.8% and 2.0% by weight. Si, which is an element which is not soluble in the cementite, prevents or at least delays carbide precipitation, in particular during bainite formation, and allows the diffusion of carbon into the retained austenite, thus favoring the stabilization of the retained austenite. Si further increases the strength of the steel by solid solution hardening. Below 0.8% by weight of silicon, these effects are not sufficiently marked. At a silicon content above 2.0% by weight, the impact resistance might be negatively impacted by the formation of big size oxides. Moreover, an Si content higher than 2.0% by weight might lead to a poor surface quality of the steel.

Preferably, the Si content is comprised between 0.9% and 2.0% by weight, more particularly between 1.0% and 2.0% by weight, even more particularly between 1.1% and 2.0% by weight, and even more particularly between 1.2% and 2.0% by weight to ensure an improved stabilization of austenite.

In another embodiment, the Si content is comprised between 0.9% and 1.5% by weight, more particularly between 1.0% and 1.5% by weight, even more particularly between 1.1% and 1.5% by weight, and even more particularly between 1.2% and 1.5% by weight.

The manganese content is comprised between 1.8% and 2.5% by weight, and preferably between 1.8 and 2.2% by weight. Mn has an important role to control the microstructure and to stabilize the austenite. As a gammagenic element, Mn lowers the transformation temperature of the austenite, enhances the possibility of carbon enrichment by increasing carbon solubility in austenite and extends the applicable range of cooling rates as it delays perlite formation. Mn further increases the strength of the material by solid solution hardening. Below 1.8% by weight, these effects are not sufficiently marked. Above 2.5% by weight, there is exaggerated segregation of the manganese, which may lead to banding in the microstructure, and which degrades the mechanical properties of the steel. An Mn content above 2.5% by weight could also excessively stabilize the retained austenite.

The inventors of the present invention believe that a reason for which the TRIP properties and other above-mentioned mechanical properties can be obtained directly on a hot rolled part which has been cooled down continuously to room temperature through air cooling without having to carry out an intermediate isothermal transformation step, such as an austempering treatment, is the particular manganese content of the steel according to the present disclosure. Indeed, the selection of a manganese content comprised between 1.8 wt. % and 2.5 wt. % provides for an optimal stabilization of the austenite in the steel. In particular, the inventors of the present invention have found out that, for cooling rates greater than or equal to 0.2° C./s, the formation of perlite or ferrite, which would detrimentally affect the mechanical properties of the steel parts, can be avoided when the manganese content is greater than or equal to 1.8 wt. %. Moreover, a manganese content greater than or equal to 1.8 wt. % contributes to the stabilization of the austenite during continuous cooling without need for holding the steel at a temperature in the bainitic range during cooling. For manganese contents greater than 2.5%, the inventors of the present invention have observed the appearance of a segregation strip which is detrimental for the other properties of the steel, such as its ductility or impact resistance.

The molybdenum content is comprised between 0% (corresponding to a trace amount of this element) and 0.4% by weight. When it is present, molybdenum improves the hardenability of the steel and further facilitates the formation of lower bainite by decreasing the temperature at which this structure appears, the lower bainite resulting in a good impact resistance of the steel.

At contents greater than 0.4% by weight, Mo can have however a negative effect on this same impact resistance, in particular of the heat affected zone during welding. Moreover, above 0.4%, the Mo addition becomes unnecessarily expensive.

Preferably, the Mo content is comprised between 0.05% and 0.2% by weight.

The chromium content is comprised between 0.5% and 1.8% by weight, preferably 0.5% and 1.5% by weight and even more preferably between 0.65% and 1.2% by weight. Chromium is effective in stabilizing the retained austenite, ensuring a predetermined amount thereof. It is also useful for strengthening the steel. However, chromium is mainly added for its hardening effect. Chromium promotes the growth of the low-temperature-transformed phases and allows obtaining the targeted microstructure in a large range of cooling rates. At contents below 0.5% by weight, these effects are not sufficiently marked. At contents above 1.8% by weight, chromium favors the formation of too large a fraction of martensite, which is detrimental for the ductility of the product. Moreover, at contents above 1.8% by weight, the chromium addition becomes unnecessarily expensive.

The niobium content of the steel is comprised between 0.02% and 0.08% by weight. By retarding carbon diffusion, niobium increases the quantity of active (or free) boron, by limiting or eliminating the formation of borocarbides of the type Fe23(CB)6, which would tie up boron and reduce the content of free boron. Thus, the combination of niobium and boron enables the rate of ferrite nucleation to be significantly reduced, leading to the formation of a wide bainite domain allowing the formation of bainite in a large range of cooling rates. Finally, niobium has a precipitation hardening effect on the steel by forming precipitates with nitrogen and/or carbon.

At contents below 0.02% by weight, the effect of niobium is not sufficiently marked. A maximum content of 0.08% by weight is allowed in order to avoid obtaining precipitates of too large a size, which would then degrade the impact resistance of the steel. Moreover, niobium, when added at a content above 0.08% by weight, leads to an increased risk of cracking defects at the surface of the billets and blooms as continually cast. These defects, if they cannot be completely eliminated, may prove very damaging in respect of the integrity of the properties of the final part especially as regards fatigue strength.

The niobium content is preferably comprised between 0.04% by weight and 0.06% by weight.

The boron content is comprised between 0.001% and 0.005% by weight. Boron segregates to the austenite grain, thus retarding ferrite nucleation and increasing the hardenability of the steel. At contents below 0.001% by weight, the effect of boron is not sufficiently marked. A content of boron above 0.005% by weight would, however, lead to the formation of brittle iron boro-carbides, as described above Nitrogen is considered to be harmful. It traps boron via the formation of boron nitrides, which makes the role of this element in the hardenability of the steel ineffective. Therefore, the nitrogen content is of at most 0.015% by weight. Nevertheless, added in small amounts, it makes it possible, via the formation in particular of niobium nitrides (NbN) or carbonitrides (NbCN) or of aluminum nitrides (AlN), to avoid excessive austenitic grain coarsening during heat treatments undergone by the steel. It also contributes to the strengthening of the steel.

The titanium content of the steel is comprised between 0.02% and 0.05% by weight. Titanium has the effect of preventing the combination of boron with nitrogen, the nitrogen being preferably combined with the titanium, rather than with the boron. Hence, the titanium content is preferably higher than 3.5*N, where N is the nitrogen content of the steel.

The sulfur content is comprised between 0% (corresponding to a trace amount of this element) and 0.4%, and more particularly between 0% and 0.01%. In the steel of the present disclosure, the sulfur should be kept as low as possible. Indeed, it tends to decrease the impact resistance and fatigue resistance of the steel. Nevertheless, as sulfur enhances the machinability, it could be added up to a level of 0.4% if a huge increase in machinability of steel is requested. At levels above 0.4%, its effect on the machinability will become saturated.

The phosphorus content is comprised between 0% (corresponding to an amount of P as a trace) and 0.1%. Even at levels below 0.1%, phosphorus retards the precipitation of iron carbide and thus favors the retention of retained austenite. Nevertheless, by segregating at the grain boundaries it reduces the cohesion thereof and decreases the steel ductility. Therefore, the phosphorus should be kept as low as possible.

The aluminum content is between 0% (corresponding to a trace amount of this element) and 1.0% by weight, preferably between 0% and 0.5% by weight, and even more preferably between 0% and 0.03% by weight.

In the steel of the present disclosure, aluminum is an optional alloying element, which is mainly used as a strong deoxidizer. Al limits the amount of oxygen dissolved in the liquid steel and improves inclusion cleanliness of the parts. Moreover, it contributes, in the form of nitrides, to control the austenitic grain coarsening during hot rolling.

Moreover, as silicon, aluminum is not soluble in cementite and thus prevents the precipitation of cementite. Therefore, aluminum can stabilize retained austenite and thus increase the amount of generated retained austenite, even when added at low contents below 1.0% by weight, or even below 0.5% by weight.

On the other hand, in an amount greater than 1.0% by weight, Al may lead to a coarsening of aluminate type inclusions which could damage the impact resistance of the steel.

The Al content is for example comprised between 0.003% by weight and 0.030% by weight.

Vanadium and nickel are optional alloying elements. Vanadium, like niobium, contributes to grain refinement. Therefore, up to 0.5% by weight of V may be added to the composition of the steel.

Nickel, for its part, provides an increase in the strength of the steel and has beneficial effects on its resistance. Therefore, up to 0.5% by weight of Ni may be added to the composition of the steel.

The hot rolled steel part according to the present disclosure has a microstructure consisting, in surface fractions, of 70% to 90% of bainite, 5% to 25% of M/A compounds and at most 25% of martensite.

The bainite and the M/A compounds contain retained austenite such that the total content of retained austenite is comprised between 5% and 25%. All the retained austenite of the steel is contained in the bainite or in the M/A compounds.

More particularly, the M/A compounds consist of retained austenite at the periphery of the M/A compound and of austenite partially transformed into martensite in the center of the M/A compound.

The retained austenite is contained in the bainite between laths of bainitic ferrite in the form of islands and films of austenite, and in the M/A compounds.

At least 5% of the retained austenite is contained in the M/A compounds. The presence of M/A compounds in the microstructure is advantageous regarding the TRIP effect of the steel. Indeed, since the retained austenite contained in the M/A compounds will transform into martensite for lower deformation rates than the retained austenite contained in the bainite (islands or films), the presence of such compounds results in a more continuous transformation into martensite throughout the deformation than if all the retained austenite was in the form of retained austenite contained in the bainite (islands or films).

The carbon content of the retained austenite is comprised between 0.8% and 1.5% by weight. A carbon content comprised in this range is particularly advantageous, since it results in a good stabilization of the retained austenite.

More particularly, the carbon content of the retained austenite is comprised between 1.0% and 1.5% by weight. This results in an even better stabilization of the retained austenite.

The thus obtained hot rolled steel part has a yield strength YS greater than or equal to 750 MPa, a tensile strength TS greater than or equal to 1000 MPa and an elongation EI greater than or equal to 10%.

The method for producing the steel part comprises casting a semi-product having the above composition. Depending on the steel product to be produced, the semi-product may be a billet, an ingot or a bloom.

The method further comprises a step of hot rolling the semi-product so as to obtain a hot rolled part.

Depending on the steel part to be produced, the hot-rolled product may be a wire or a bar.

The hot rolling is performed with a hot rolling starting temperature higher than 1000° C. For example, before hot-rolling, the semi-product is reheated to a temperature comprised between 1000° C. and 1250° C. and then hot rolled.

After hot rolling, the hot rolled part is cooled down to room temperature through air cooling, and for example through natural air cooling or through controlled pulsed air cooling.

In the case of air cooling, the hot rolled part is cooled down continuously from the hot rolling temperature to the room temperature, without being held at a particular intermediate temperature. In this context, an intermediate temperature is a temperature comprised between the hot rolling temperature and the room temperature, different from the hot rolling temperature and the room temperature.

In the case of natural air cooling, the product is left to cool in ambient air, without forced convection.

Controlled pulsed air cooling can for example be obtained through the use of ventilators, whose operation is controlled depending on the desired cooling rate.

The cooling rate in the core of the hot rolled product during air cooling from the hot rolling end temperature down to room temperature is advantageously greater than or equal to 0.2° C./s, and for example smaller than or equal to 5° C./s.

The method for producing a steel part according to the present disclosure may optionally comprise, after the hot rolling step, a step of carrying out a heat treatment on said hot rolled part so as to obtain a hot rolled and heat treated steel part.

The heat treatment step is in particular carried out after cooling, and in particular after air cooling, the hot rolled steel part to room temperature.

Such a heat treatment may in particular comprise heating said hot rolled steel part to a heat treatment temperature greater than or equal to the $Ac_3$ temperature of the steel for a time comprised between 10 minutes to 120 minutes such that, at the end of the heating step, the steel has an entirely austenitic microstructure.

More particularly, the heat treatment temperature is comprised between $AC_3$+50° C. and 1250° C.

The hot rolled steel part is preferably held at the heat treatment temperature for a time comprised between 30 minutes and 90 minutes.

The heating may be carried out in an inert atmosphere, and for example in a nitrogen atmosphere.

Preferably, the heating step is followed by air cooling from said heat treatment temperature to room temperature so as to obtain a hot rolled and heat treated steel part.

The cooling rate in the core of the product during air cooling from the heat treatment temperature down to room temperature is advantageously greater than or equal to 0.2° C./s, and for example smaller than or equal to 5° C./s.

In the case of air cooling, the part is cooled down continuously from the heat treatment temperature to the room temperature, without being held at a particular intermediate temperature. In this context, an intermediate temperature is a temperature comprised between the heat treatment temperature and the room temperature, different from the heat treatment temperature and the room temperature.

The air cooling is in particular a natural air cooling or a controlled pulsed air cooling.

At the end of this heat treatment step, a hot rolled and heat treated steel part is obtained.

Optionally, the method for producing the steel part may include a step of cold rolling. The cold rolling step may be carried out directly after the hot rolling step, without an intermediate heat treatment. If the method comprises a heat treatment step, the cold rolling step is carried out respectively after the heat treatment step.

According to one embodiment, the hot rolled steel part and/or the hot rolled and heat treated steel part produced through the above method is a solid wire, having a diameter comprised between 5 and 35 mm.

According to another embodiment, the hot rolled steel part and/or the hot rolled and heat treated steel part produced through the above method is a solid bar having a diameter comprised between 25 and 100 mm.

The diameter of the solid bar may for example be equal to about 30 mm or to about 40 mm. In particular, the diameters of the hot rolled steel part and/or the hot rolled and heat treated steel part are equal.

The hot rolled steel part and the hot rolled and heat treated steel parts may have different lengths, the length of the hot rolled and heat treated steel part being smaller than that of the hot rolled steel part. For example, the hot rolled steel part may have been cut into smaller parts prior to performing the heat treatment.

Advantageously, the method further comprises a step of deforming the part to obtain a deformed part. This forming step may be a cold forming or a hot forming step, and may be performed at various stages of the process. The forming step is for example a press forming step.

According to a first embodiment, the forming step is performed after the hot-rolled steel part is cooled to the room temperature, and before any optional heat treatment.

In this first embodiment, the forming step is a cold-forming step.

In this embodiment, the part obtained after the cold-forming step is a hot rolled and deformed steel part.

The hot rolled and deformed steel part may be subsequently subjected to an austenitizing heat treatment as disclosed above so as to obtain a hot rolled, deformed and heat treated steel part. In the case where an austenitizing heat treatment as disclosed above is performed, the microstructure of the hot rolled, deformed and heat treated steel part is the same as the microstructure of the hot rolled steel part or of the hot rolled and heat treated steel part. Indeed, the heat treatment restores the microstructure present prior to the cold forming.

Alternatively, the hot rolled and deformed steel part may be subjected to a stress release heat treatment intended for removing the residual stresses resulting from cold forming. Such a stress removal heat treatment is for example performed at a temperature comprised between 100° C. and 500° C. for a time comprised between 10 and 120 minutes.

According to a second embodiment, the forming step is a cold forming step performed on the hot rolled and heat treated steel part, i.e. after the heat treatment is performed.

In this embodiment, after the cold forming step, a hot rolled, heat treated and deformed steel part is obtained.

In this embodiment, the cold forming step may be optionally followed by an austenitizing heat treatment step as disclosed above, for example if it is desired to restore the initial microstructure of the steel part prior to cold forming or by a stress release heat treatment step as disclosed above.

According to a third embodiment, the forming step is performed during the heat treatment, especially after the hot rolled steel part is heated to the heat treatment temperature and before the cooling down to the room temperature.

In this third embodiment, the forming step is a hot forming step, preferably a hot press forming step. After cooling down to the room temperature, a hot rolled, heat treated and deformed steel part is obtained.

The hot rolled, optionally heat treated, and deformed steel part is for example a common rail of a fuel injection system of a diesel engine.

Optionally, the method may further comprise finishing steps, and in particular machining or surface treatment steps, performed after the forming step. The surface treatment steps may in particular comprise shot peening, roller burnishing or autofrettage.

EXAMPLES

Microstructure Analysis

The microstructure was analyzed based on cross-sections of the samples. More particularly, the structures present in the cross-sections were characterized by light optical microscopy (LOM) and by scanning electron microscopy (SEM).

The LOM observations were performed after etching using a 2% Nital solution.

For SEM observations, samples have been polished with colloidal silica (after the last polishing step). A lower concentration Nital etching, at a concentration of 0.5-1% is performed to reveal slightly the metallographic structure.

The microstructures of the steels were characterized using colour etching for distinguishing martensite, bainite and ferrite phases using the LePera etchant (LePera 1980). The etchant is a mixture of 1% aqueous solution of sodium metabisulfite (1 g Na2S205 in 100 ml distilled water) and 4% picral (4 g dry picric acid in 100 ml ethanol) that are mixed in a 1:1 ratio just before use.

LePera etching reveals primary phases and second phases such as type of bainite (upper, lower), martensite, islands and films of austenite or M/A compounds. After a LePera etching, ferrite appears light blue, bainite from blue to brown (upper bainite in blue, lower bainite in brown), martensite from brown to light yellow and M/A compounds in white, under a light optical microscope and at a magnification of 1000.

The amount of M/A compounds in percentage for a given area in the images was then measured using an adapted image processing software, in particular the ImageJ software of processing and image analysis allowed quantifying.

The inventors further measured the total content of retained austenite by sigmametry or X-Ray diffraction. These techniques are well known to the skilled person.

Mechanical Properties

Tensile tests were performed using test specimen type TR03 (Ø=5 mm, L=75 mm). Each value is the average of two measurements.

A hardness profile along the cross section of the samples was performed. Vickers hardness tests were carried out with a load of 30 kg for 15 seconds durations.

In the following tables, the following abbreviations were used:

UB=Upper bainite

LB=Lower bainite

M/A=Martensite/retained austenite compounds

RA=Retained austenite.

TS (MPa) refers to the tensile strength measured by tensile test (ASTM) in the longitudinal direction relative to the rolling direction, YS (MPa) refers to the yield strength measured by tensile test (ASTM) in the longitudinal direction relative to the rolling direction, Ra (%) refers to the percent reduction of area measured by tensile test (ASTM) in the longitudinal direction relative to the rolling direction, El (%) refers to the elongation measured by tensile test (ASTM) in the longitudinal direction relative to the rolling direction.

The inventors of the present invention have carried out the following experiments.

They have cast billets made from steels having the compositions listed in the below table 1.

TABLE 1

| Steel | C (%) | Si (%) | Mn (%) | N (%) | Mo (%) | Nb (%) | Ti (%) | B (%) | Cr (%) | Ni (%) | P (%) | S (%) | Al (%) | Rest |
|---|---|---|---|---|---|---|---|---|---|---|---|---|---|---|
| 1 | 0.180 | 1.2 | 2.1 | 0.008 | 0.06 | 0.06 | 0.04 | 0.0025 | 1.30 | 0.014 | 0.010 | 0.008 | 0.030 | Fe |
| 2 | 0.200 | 1.2 | 2.1 | 0.008 | 0.06 | 0.06 | 0.04 | 0.0025 | 1.40 | 0.013 | 0.008 | 0.008 | 0.019 | Fe |
| 3 | 0.25 | 1.3 | 2.2 | 0.008 | 0.100 | 0.06 | 0.04 | 0.0025 | 1.45 | 0.013 | 0.008 | 0.006 | 0.027 | Fe |

In the above table 1, the contents are indicated in weight %.

They have then hot rolled these semi-products above 1000° C. to produce bars having a diameter of 40 mm that were naturally cooled. The thus obtained bars are called "as rolled" in the following.

Then, some blanks sampled from these bars were subjected to a heat treatment consisting of an austenitization followed by a natural air cooling down to the room temperature.

The austenitization conditions are the following:

Temperature: 1200° C.

Holding time (at temperature): 75 min

Inerting: argon atmosphere.

The thus obtained samples are called "heat treated" in the following.

Additionally, other blanks sampled from the hot-rolled bars ("as rolled") obtained above were subjected to an austempering treatment. More particularly, they were first subjected to austenitization, as described above, and were then air cooled and held in a salt bath at a temperature depending on the steel grade for a predetermined holding time, then finally air cooled to room temperature so as to obtain "austempered" samples.

More particularly, the following holding temperatures and times were used:

Steel 1: 400° C. for 15 minutes

Steel 2: 380° C. for 15 minutes

Steel 3: 360° C. for 60 minutes.

For each of the above steels, the "as rolled", "heat treated" and "austempered" samples were analyzed as to their microstructure, retained austenite content, hardness, hardenability, mechanical properties (yield strength, tensile strength, elongation and reduction of area, toughness). The microstructural features and the mechanical properties were determined as disclosed above.

The following table 2 summarizes the results of the microstructure analyses.

TABLE 2

| Grade | Thermal state | Micro-structure | Content of retained austenite (%) | Mean M/A compounds fraction (%) | Carbon content in retained austenite (%) |
|---|---|---|---|---|---|
| 1 | As-rolled bar | UB (85%) + M/A (10-15%) + LB (traces) | 12.2% | 12.9% | 1.12 |
| | Heat treated sample | UB (80%) + M/A (15-20%) | 14.3% | 17.7% | 1.08 |
| | Austempered sample | LB (30%) + UB (50%) + M/A (15-20%) | 10.3% | 18.7% | 0.91 |
| 2 | As-rolled bar | UB (85%) + M/A (10-15%) + some LB (<5%) | 11.7% | 11.2% | 1.12 |
| | Heat treated sample | UB (75%) + M/A (20%) + LB (5%) | 13.1% | 21.2% | 1.10 |
| | Austempered sample | UB (35%) + LB (50%) + M/A (10-15%) | 9.1% | 14.5% | 1.09 |
| 3 | As-rolled bar | UB/LB (75%) + M (15%) + M/A (estimated <10%) | 14.7% | <10% | 1.23 |
| | Heat treated sample | LB (75%) + M (15%) + M/A (estimated <10%) + UB (traces) | 14.6% | <10% | 1.18 |
| | Austempered sample | LB (80%) + M (10%) + M/A (estimated <10%) | 10.5% | <10% | 0.96 |

For all grades in table 2, the microstructure of the "as-rolled", "heat treated" and "austempered" samples was observed to be quite homogeneous throughout the section.

The scanning electron microscopy observations have highlighted the M/A compounds present in the bainitic matrix. Observations at high magnification show that M/A compounds are composed of retained austenite and retained austenite partially transformed into martensite. Furthermore, retained austenite is rather concentrated at the periphery of the compounds.

Morphology and constitution of the M/A compounds are the same for all grades.

The below table 3 summarizes the results of the mechanical property measurements.

TABLE 3

| Grade | Sample | YS (MPa) | TS (MPa) | Ra (%) | EI (%) | Average hardness (HV30) |
|---|---|---|---|---|---|---|
| 1 | As rolled | 892 | 1288 | 48.7 | 16.5 | 397 |
| | Heat treated | 875 | 1264 | 41 | 15.3 | 385 |
| | Austempered | 914 | 1392 | 36 | 12.1 | n.d. |
| 2 | As rolled | 899 | 1284 | 34.5 | 13.7 | 399 |
| | Heat treated | 884 | 1268 | 42.6 | 15.1 | 375 |
| | Austempered | 901 | 1367 | 35.9 | 12.5 | n.d. |
| 3 | As rolled | 994 | 1400 | 48.4 | 15.8 | 449 |
| | Heat treated | 952 | 1384 | 42.7 | 15.5 | 428 |
| | Austempered | 897 | 1426 | 36.1 | 14.0 | n.d. |

In order to evaluate the hardenability of the different steel grades, a Jominy end quench test was carried out using the following treatment conditions:

austenitisation temperature: 1150° C.

holding time: 50 min

This test has shown "flat" Jominy curves for all the above tested steels. Therefore, all the above tested steel grades have a very good hardenability and are adapted to produce high strength large diameter parts with homogenous mechanical properties.

The results of the hardness measurements further show that the hardness is substantially uniform all along the cross section of as-rolled samples. This confirms the good homogeneity of the structures along the transversal section and thus the good hardenability.

The tensile tests carried out by the inventors on the different samples have further shown that the samples undergo a TRIP (Transformation induced plasticity) effect during deformation, since almost all the austenite was transformed into martensite during these tensile tests.

The above results confirm that excellent results in terms of mechanical properties and microstructures are already obtained after natural air cooling following hot rolling. It is therefore not necessary to carry out an intermediate isothermal transformation step, such as an austempering treatment.

The steel parts according to the present disclosure are particularly advantageous.

Indeed, and as is confirmed by the above results, the steel composition according to the present disclosure allows obtaining parts having excellent mechanical properties, in particular in terms of yield strength, elongation, hardness and hardenability, directly after hot-rolling and air cooling, without having to perform any particular additional heat treatments, and in particular austempering. Therefore, such good mechanical properties may be obtained at reduced manufacturing costs and efforts as compared with prior art steels having similar properties.

The inventors have further confirmed that the steels according to the present disclosure undergo the desired TRIP effect during deformation.

Of course, depending on the needs, an austempering treatment may optionally be carried out on the product, for example after cold rolling, but such a heat treatment is not needed for obtaining the advantageous mechanical properties.

What is claimed is:

1. A hot rolled steel part having a composition comprising, by weight:

0.10%≤C≤0.35%
1.2%≤Si≤1.5%
2.1%≤Mn≤2.5%
P≤0.1%
0%≤S≤0.4%
0%≤Al≤1.0%
N≤0.015%
0%≤Mo≤0.4%
0.04%≤Nb≤0.06%
0.02%≤Ti≤0.05%
0.001%≤B≤0.005%
0.5%≤Cr≤1.8%
0%≤V≤0.5%
0%≤Ni≤0.5% a remainder being Fe and unavoidable impurities resulting from smelting, the hot rolled steel part having a microstructure consisting, in surface fraction, of 70% to 90% of bainite, 5% to 25% of M/A compounds and at most 25% of martensite, the bainite and the M/A compounds containing retained austenite such that a total content of retained austenite in the hot rolled steel part is comprised between 5% and 25% and a carbon content of the retained austenite being comprised between 0.8% and 1.5% by weight.

2. A hot rolled steel part having a composition comprising, by weight:

0.10%≤C≤0.35%
0.8%≤Si≤2.0%
1.8%≤Mn≤2.5%
P≤0.1%
0%≤S≤0.4%
0%≤Al≤1.0%
N≤0.015%
0%≤Mo≤0.4%
0.02%≤Nb≤0.08%
0.02%≤Ti≤0.05%
0.001%≤B≤0.005%
0.5%≤Cr≤1.8%
0%≤V≤0.5%
0%≤Ni≤0.5% a remainder being Fe and unavoidable impurities resulting from smelting, the hot rolled steel part having a microstructure consisting, in surface fraction, of 70% to 90% of bainite, 5% to 25% of M/A compounds and at most 25% of martensite, the bainite and the M/A compounds containing retained austenite such that a total content of retained austenite in the hot rolled steel part is comprised between 5% and 25% and a carbon content of the retained austenite being comprised between 0.8% and 1.5% by weight, the hot rolled steel part being a solid bar having a diameter between 25 mm and 100 mm or a wire with a diameter between 5 mm and 35 mm.

3. The hot rolled steel part according to claim 2, wherein the hot rolled steel part has a yield strength (YS) greater than or equal to 750 MPa, a tensile strength (TS) greater than or equal to 1000 MPa and an elongation (EI) greater than or equal to 10%.

4. The hot rolled steel part according to claim 2, wherein the hot rolled steel part is the solid bar having a diameter comprised between 25 and 100 mm.

5. The hot rolled steel part according to claim 2, wherein the hot rolled steel part is the wire having a diameter comprised between 5 and 35 mm.

6. The hot rolled steel part according to claim 2, wherein the composition comprises, by weight, 1.2%≤Si≤1.5%.

7. The hot rolled steel part according to claim 2, wherein the composition comprises, by weight, 0.05%≤Mo≤0.2%.

8. The hot rolled steel part according to claim 2, wherein the composition comprises, by weight, 0.04%≤Nb≤0.06%.

9. The hot rolled steel part according to claim 2, wherein the composition comprises, by weight, 2.1%≤Mn≤2.5%.

10. The hot rolled steel part according to claim 2, wherein the composition comprises, by weight, 2.1%≤Mn≤2.2%.

11. The hot rolled steel part according to claim 2, wherein the composition comprises, by weight:

1.2%≤Si≤1.5%, 0.04%≤Nb≤0.06%, 2.1%≤Mn≤2.5%.

12. A method for manufacturing a steel part, comprising the following successive steps:

casting a steel so as to obtain a semi-product;

hot rolling the semi-product at a hot rolling starting temperature higher than 1000° C. and cooling the hot rolled product thus obtained through air cooling to room temperature so as to obtain a hot rolled steel part, a cooling rate in a core of the hot rolled product during the air cooling from a hot rolling end temperature down to the room temperature being greater than or equal to 0.2° C./s, the hot rolled steel part being, after the air cooling to the room temperature, the hot-rolled steel part recited in claim 2.

13. The method according to claim 12, further comprising a step of reheating the semi-product to a temperature comprised between 1000° C. and 1250° C. prior to the hot rolling, the hot rolling being carried out on the reheated semi-product.

14. The method according to claim 12, wherein the steel comprises between 0.9% and 2.0% by weight of silicon.

15. The method according to claim 12, wherein the steel comprises between 1.8% and 2.2% by weight of manganese.

16. The method according to claim 12, wherein the steel comprises between 0% and 0.030% by weight of aluminum.

17. The method according to claim 12, wherein the steel comprises between 0.05% and 0.2% by weight of molybdenum.

18. The method according to claim 12, wherein the titanium and nitrogen contents are such that Ti≥3.5×N.

19. The method according to claim 12, wherein the steel comprises between 0.5% and 1.5% by weight of chromium.

20. The method according to claim 12, wherein after hot-rolling, the hot rolled steel part is cooled to the room temperature.

21. The method according to claim 20, wherein, after the cooling to the room temperature, the hot rolled steel part is cold press-formed, to obtain a hot rolled and deformed steel part.

22. The method according to claim 20, wherein after the cooling to the room temperature, the hot rolled steel part is cold formed to obtain a hot rolled and deformed steel part.

23. The method according to claim 12, further comprising, after the hot rolling step, a step of heating the hot rolled steel part to a heat treatment temperature greater than or equal to an $Ac_3$ temperature of the steel for a time comprised between 10 minutes and 120 minutes, followed by cooling from the heat treatment temperature to the room temperature so as to obtain a hot rolled and heat treated steel part.

24. The method according to claim 23, wherein the cooling from the heat treatment temperature to the room temperature is an air cooling.

25. The method according to claim 23, wherein, between the heating of the hot rolled steel part to the heat treatment temperature and the cooling to the room temperature, the hot rolled steel part is hot formed, the hot rolled and heat treated steel part being a hot-rolled, heat treated and deformed steel part.

26. The method according to claim 23, wherein, after the cooling from the heat treatment temperature to the room temperature, the hot rolled and heat treated steel part is cold formed, to obtain a hot-rolled, heat treated and deformed steel part.

27. The method according to claim 23, wherein the cooling from the heat treatment temperature to the room temperature is a natural air cooling or a controlled pulsed air cooling.

28. The method according to claim 23, wherein, between the heating of the hot rolled steel part to the heat treatment temperature and the cooling to the room temperature, the hot rolled steel part is hot press formed, the hot rolled and heat treated steel part being a hot-rolled, heat treated and deformed steel part.

29. The method according to claim 23, wherein, after the cooling from the heat treatment temperature to the room temperature, the hot rolled and heat treated steel part is cold press formed, to obtain a hot-rolled, heat treated and deformed steel part.

30. The method according to claim 12, wherein after hot-rolling, the hot rolled steel part is cooled to the room temperature, the cooling being performed by air cooling.

31. The method according to claim 30, wherein the cooling is performed by natural air cooling or through controlled pulsed air cooling.

* * * * *